US009593470B2

(12) United States Patent
Dallard et al.

(10) Patent No.: US 9,593,470 B2
(45) Date of Patent: Mar. 14, 2017

(54) BUCKET CORNER, GROUND ENGAGING TOOL AND MUTUAL MECHANICAL ATTACHMENT THEREOF

(71) Applicant: SANDVIK INTELLECTUAL PROPERTY AB, Sandviken (SE)

(72) Inventors: Bradley John Dallard, Leeming (AU); Marten Bjorn Karlsson, Yangebup (AU); Benjamin Edward Smeaton, Perth (AU); Kamil Rogozinski, Joondana (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/425,627

(22) PCT Filed: Sep. 4, 2013

(86) PCT No.: PCT/IB2013/001899
§ 371 (c)(1),
(2) Date: Mar. 3, 2015

(87) PCT Pub. No.: WO2014/037781
PCT Pub. Date: Mar. 13, 2014

(65) Prior Publication Data

US 2015/0211215 A1 Jul. 30, 2015

(30) Foreign Application Priority Data

Sep. 4, 2012 (AU) ..... 2012903828
Apr. 29, 2013 (AU) ..... 2013901488

(51) Int. Cl.
*E02F 9/28* (2006.01)
*E02F 3/40* (2006.01)

(52) U.S. Cl.
CPC ..... *E02F 9/2883* (2013.01); *E02F 3/40* (2013.01); *E02F 9/2816* (2013.01); *E02F 9/2858* (2013.01)

(58) Field of Classification Search
CPC ..... E02F 9/2825; E02F 9/2833; E02F 9/28; E02F 9/2841; E02F 9/2816; E02F 9/2888;
(Continued)

(56) References Cited

U.S. PATENT DOCUMENTS 3,812,608 A * 5/1974 Ratkowski ..... E21C 27/30 37/448
3,961,788 A * 6/1976 Helton ..... E02F 9/28 172/701.2

(Continued)

FOREIGN PATENT DOCUMENTS

JP H11229422 A 8/1999
JP 2001342649 A 12/2001

*Primary Examiner* — Robert Pezzuto
(74) *Attorney, Agent, or Firm* — Corrine R. Gorski

(57) ABSTRACT

An earthmoving equipment bucket corner has a first portion, a second portion and an intermediate portion between the first and second portions, all in different planes to one another. A boss or lug is provided on the leading edge of the intermediate portion. The intermediate portion is angled relative to both the first and second portions, which alleviates the load stresses otherwise created in a traditional 90° corner. The first portion has a wall with a taper or bevel towards a forward edge. The second portion has a wall with a leading flared wall portion that widens the corner at the front. The intermediate portion is preferably at an included angle of around 120° to 170° with respect to the respective walls of the first and second portions.

21 Claims, 13 Drawing Sheets

(58) Field of Classification Search
CPC ..... E02F 9/2858; E02F 3/40; E02F 9/2883; E01C 27/30; E01H 5/061; E01H 5/066
USPC ..... 37/448, 455, 458; 172/701.1–701.3
See application file for complete search history.

(56) References Cited

U.S. PATENT DOCUMENTS

| | | | | |
|---|---|---|---|---|
| 4,047,312 | A | 9/1977 | Stepe | |
| 4,601,119 | A * | 7/1986 | Klett | E02F 9/2808 172/704 |
| 6,240,663 | B1 | 6/2001 | Robinson | |
| 2004/0025381 | A1 | 2/2004 | Cox et al. | |

* cited by examiner

BUCKET CORNER, GROUND ENGAGING TOOL AND MUTUAL MECHANICAL ATTACHMENT THEREOF

RELATED APPLICATION DATA

This application is a §371 National Stage Application of PCT International Application No. PCT/IB2013/001899 filed Sep. 4, 2013 claiming priority of AU Application Nos. 2012903828, filed Sep. 4, 2012 and 2013901488, filed Apr. 29, 2013.

FIELD OF THE INVENTION

The present invention relates to the underlying structures for mechanical connection of wear parts and to means for wear part connection to such structures.

The present invention has been created in relation to buckets used by earthmoving equipment and to the connection of ground engaging tools to such buckets.

BACKGROUND TO THE INVENTION

Ground engaging tools (GET), for earth-moving equipment, such as those used in mining operations, operate in a highly abrasive environment, are subjected to high impact forces and therefore wear out or become damaged through use. GET, such as teeth used on the front lip or edges of a bucket of the earth moving equipment, therefore require regular replacement.

Traditionally, GETs are welded onto the lips of buckets. When the GET come to the end of their useful life, they can be cut from the bucket, and new GET welded in their place.

The GET and the underlying structure of the bucket are subjected, in use, to high load forces and impacts. Traditionally the right angled corners of the buckets have been protected by GET (also called shrouds) mounted along the leading edge or lip of the floor of the bucket and also along the leading edge of the upright sides of the bucket. It has, however, been realised that load forces and impact at the respective corners between the upright sides and the bucket floor can cause fractures and potentially early failure of the material of the structure of the bucket at or adjacent the corners. Often the corners of buckets are precast in steel, and then the floor and remaining side structures and cast corners are welded together. This is a time consuming and costly process that must usually be done in a workshop to ensure accuracy and quality of reconstruction. Downtime of equipment also adds to loss of productivity and increased operating costs to a business. Structural failure of buckets is therefore to be avoided. The present invention has been realised with these problems in mind.

In addition, it will be appreciated that cutting and re-welding operations to replace welded-on GET are complex, time-consuming and relatively expensive. Further, as with repairs to buckets, they must generally be done in a workshop to ensure the cutting off and welding is done correctly, requiring the bucket to be transported away from the earthmoving equipment.

Various mechanical attachment methods have been proposed in an attempt to alleviate these problems. Many of the methods involve the use of bolts and similar fastening devices, inserted within the lip of the bucket. In general, such devices have proved to be of limited use. The insertion of a bolt or similar within a bucket lip can lead to undesirable stress concentrations within the lip, resulting in cracking of the bucket lip. Even where this is avoided, the large forces to which GET are exposed have a tendency to deform connecting bolts, thus making difficult their subsequent extraction using mechanical tools. Indeed, in some cases the deformation can be so severe that the GET must be cut away, completely negating any advantage of mechanical connection.

In response to these issues, the applicant has devised a number of mechanical connection means which overcome these problems. Examples of the applicant's devices are detailed in U.S. Pat. No. 7,219,454 and in U.S. Pat. No. 7,472,503 and in U.S. patent application Ser. No. 13/133,213 (also published as International PCT publication number WO 2010/065990), the contents of all of which are included herein by reference.

These connection means involve the use of a shroud which mounts about a lug or boss on the lip of an excavator bucket; a locking device which locates between the shroud and the boss; and the application of an external compressing force to maintain the relative position of the shroud, locking device and boss.

Although these connection means have proved far less susceptible to deformation than previous mechanical connectors, there have nonetheless been occasions where the connection means have had one or more problems. Sometimes failure of the GET or connection means can occur when the GET is in use due to a load being applied which is higher than the means can bear. The number of individual components forming the connection means can make fitting/refitting a GET time consuming. Other times, when it is necessary to remove the GET, the connection means is troublesome to undo to release the GET from the bucket, or, even if the connection means is released, the GET does not readily remove from the bucket lip, usually because of dirt and/or deformation of the connection means and/or GET preventing removal. A further form of the present invention has been devised with these problems in mind.

The present invention seeks to provide a means by which earthmoving equipment buckets are less prone to structural failure at the lower, and preferably connection of GET on earthmoving equipment can be substantially improved.

SUMMARY OF THE INVENTION

In accordance with a first aspect of the present invention there is provided an earthmoving equipment bucket corner including a first portion, a second portion and an intermediate portion extending between the first and second portions, wherein the first, second and intermediate portions are in different planes to one another.

Preferably the first portion provides a floor portion for the bucket, and preferably the second portion provides a wall portion for the bucket. The intermediate portion may connect the first and second portions.

The intermediate portion or the plane of the intermediate portion may be angled with respect to the first and second portions.

Preferably the corner is precast as a one piece component. Alternatively, the corner may be fabricated from multiple components, such as being welded from individual parts or a combination of cast and plate components.

The first and second portions may extend beyond a boundary of the intermediate portion and may connect together adjacent that boundary of the intermediate portion. The first and second portions may connect together in a continuum of material of the corner beyond the boundary of the intermediate portion.

The first and intermediate portions, and the second and intermediate portions, and preferably the first and second portions in the region beyond the boundary of the intermediate portion, may meet without a discontinuity of a sharp corner. The portions preferably meet at a radiused continuity of material rather than an abrupt deflection in the plane of each respective portion. Preferably the radius of curvature of the internal faces of the portions from one portion to the next is between 20 mm and 80 mm. This smooth radiused continuity form one portion to the next avoids sharp corners that otherwise create stress zones and likely failure points for the corner.

The corner may have a front peripheral region arranged to receive a boss, lug or adapter for mounting a ground engaging tool (GET) or wear plate to the corner. Hereinafter, the boss, lug or adapter are deemed equivalent and are each referred to as a 'boss' for ease of reading of this specification.

The boss may be welded to the intermediate portion or may be precast with the intermediate portion as a discrete part or as part of a cast corner.

The intermediate portion or the plane of the intermediate portion may be angled at between 120° and 170° with respect to one or both of the first and second portions. Thus, the intermediate portion or the plane of the intermediate portion may be angled at 120° with respect to one of the first or second portions, and at 150° with respect to the other of the first or second portions. Alternatively, the intermediate portion or the plane of the intermediate portion may be angled at 135° with respect to one or both of the first and second portions.

The first, second and/or intermediate portions may taper from a respective body portion of each to a narrower profile front edge of the front peripheral region.

The intermediate portion may blend into the first portion and/or into the second portion by a continuous curve of material. The continuous curve of material may be formed by casting the corner as a one piece component.

Preferably the corner widens between a front region and a rear region of the corner. The front region includes the front boundary with the tapered edge to receive a GET. The rear region is arranged to be connected, such as by welding, to a body of the bucket.

The corner may include a first exterior surface that forms part of an interior bowl of a bucket for receiving material into the bucket, and a second exterior surface that forms part of an exterior surface of the bucket for contact with material exterior to the bucket. The second exterior surface of the corner may include a recessed region, which may receive part of a ground engaging tool mounted to the corner.

The rear exterior region of the corner beyond the recessed region may widen out the corner so that a greater amount of material may be included in the corner, such as for added strength, impact and deformation resistance and longevity of the corner, and ultimately the bucket, in use.

The plane of the first portion may meet the plane of the intermediate portion at an included angle of between around 100° to 175°. Preferably the included angle is between around 120° and 170°, and more preferably between 120° and 150°. Similarly with the included angle between the plane of the second portion and the plane of the intermediate portion.

A further aspect of the present invention provides a ground engaging tool (GET) including a wear part for engagement with material when in use and a mounting portion to mount the GET to earthmoving equipment, the mounting portion including an internal opening into the GET, the opening having a first GET portion, a second GET portion and an intermediate GET portion between the first and second GET portions, wherein the first, second and intermediate GET portions are in different planes to one another.

The first, second and intermediate GET portions are preferably arranged and configured such that the opening into the GET receives respectively a first bucket corner portion, a second bucket corner portion and an intermediate bucket corner portion of a bucket corner, the first, second and intermediate bucket corner portions are also in different planes to one another.

The GET may provide a wear part to protect the corner of the bucket. The bucket corner may transfer load and impact forces from the GET to the side and/or floor of the bucket.

The GET may be a corner GET in that the GET protects the corner and is arranged to be mounted at the end of a row of GETS mounted to a front edge or lip of a bucket. The corner GET may provide a wedge of wear material such that the corner GET is thicker at its outer edge to protect an outermost side boundary of the bucket corner than the inner edge of the corner GET arranged to be adjacent to another GET.

The GET may mount to the bucket corner by a connection means. The connection means may be inserted into a recess into the GET. The recess may open into or connect with or form part of the opening in the GET to receive a portion of the bucket corner therein.

The GET may have a blade portion that broadens outwards from a connection portion of the GET for mounting the GET to the edge or lip of the bucket to the leading edge of the blade portion of the GET. Alternatively, or in addition, the blade portion of the GET deviating or deflecting to one side with respect to the connection portion. Thus, the GET may angle outwards with respect to a bucket to which it is to be mounted.

The GET may have an inner face that abuts, in use, a next adjacent GET, the inner face angled outwards from the bucket edge or lip to a leading edge of the GET. This allows a standard GET to be mounted next adjacent to the corner GET, thereby avoiding the need for an intermediate type GET with a tapered blade. This reduces the need for an additional, tapered, type GET.

A further aspect of the present invention provides a ground engaging tool (GET) system, including a GET, a bucket corner and a GET connection means, the GET including a wear part for engagement with material when in use and a mounting portion to mount the GET to earthmoving equipment, the mounting portion including an internal opening into the GET, the opening having a first GET portion, a second GET portion and an intermediate GET portion between the first and second GET portions, wherein the first, second and intermediate GET portions are in different planes to one another, the first, second and intermediate GET portions are preferably arranged and configured such that the opening into the GET receives respectively a first bucket corner portion, a second bucket corner portion and an intermediate bucket corner portion of a bucket corner, the first, second and intermediate bucket corner portions are also in different planes to one another, and the connection means arranged to connect the GET to the bucket corner.

Preferably the connection means is a releasable device such that the GET can be releasably tightened to the bucket corner and released by un-tightening the connection means to remove the GET.

The bucket corner of the present invention beneficially reduces stress points and smoothes transitions between faces to help distribute forces through two transition points where faces meet rather than through one transition point at the corner of a regular 'square' bucket corner.

The present invention also increases the bearing surface for a GET closer to where impacts are felt through the corner.

Also, the shape and configuration of the angled faces provides for an area of relief under the corner to give more space for GET (shroud) material, therefore further saving on bucket corner wear because the corner wears out less quickly, and thereby saving on costly downtime to remove and repair the bucket.

The plane of the intermediate portion may meet the plane of the first portion (the floor of the bucket) an exterior angle of between 15° and 25° with respect to the plane of the first portion. That is, the intermediate portion may project from the plane of the floor of the bucket by an angle of between 15° and 25°. Preferably that angle is between 18° and 22°, and more preferably substantially or generally 20°;

This shallower angle (shallower than a 30° angle) lowers the effective height extent of the corner. The shallower angle also lowers fatigue on the material of the corner at the transitions from one surface to the next, especially at the radiused transitions from the intermediate portion to each of the first and second portions. The shallower angle also helps reduce weight from the corner shroud due to the decreased height, and also gives improved perceived or actual penetration of the bucket into material to be picked up by the bucket. Reducing the angle to give a lower height corner also improves shroud engagement to the corner during fitment of the shroud.

BRIEF DESCRIPTION OF THE DRAWINGS

It will be convenient to further describe the invention with reference to preferred embodiments of the present invention. Other embodiments are possible, and consequently, the particularity of the following discussion is not to be understood as superseding the generality of the preceding description of the invention. In the drawings.

DESCRIPTION OF PREFERRED EMBODIMENTS

Figure 1:
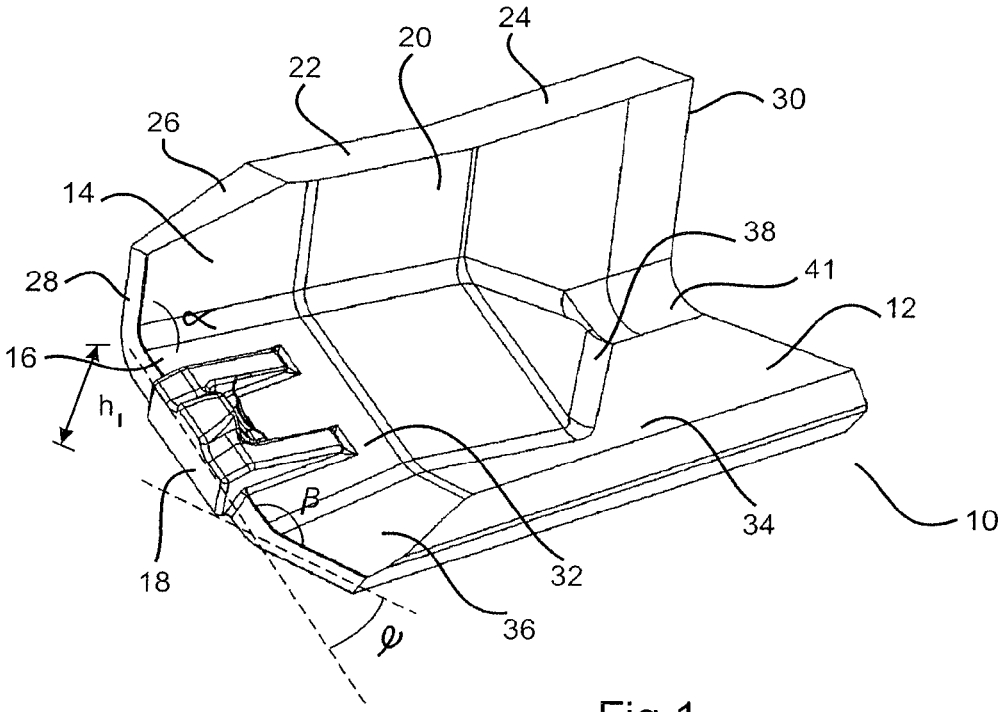
FIG. 1 shows a bucket corner with a boss according to an embodiment of the present invention.

As shown in FIG. 1, the bucket corner 10 of an embodiment of the present invention includes a first portion 12, a second portion 14 and an intermediate portion 16 between the first and second portions. A boss or lug 18 is attached by welding to the front region of the intermediate portion. Alternatively, the boss or lug may be cast into the material of bucket corner. The bucket corner is cast in one piece. However, a fabricated corner is envisaged to fall within the scope of the present invention.

The intermediate portion is angled relative to both the first and second portions. Thus, instead of a traditional 90° internal corner where the side wall and floor of the bucket meet at the corner, the corner of the present invention provides an angled corner face.

The first portion has a wall 34 that forms part of the floor of the bucket when welded into place. This wall has a taper or bevel 36 towards a forward edge thereof.

The second portion 14 forms part of the side wall of a bucket when welded into place. The second portion includes a wall 20 with a leading flared wall portion 22 that widens the corner at the front 28 thereof with respect to the rear 30 thereof. The wall also has a straight rear portion 24. The leading portion also has a taper 26.

The intermediate portion provides a wall 32 between the first and second portions. However, the walls 24, 34 of the respective first and second portions meet 41 beyond the boundary 38 of the intermediate portion.

The intermediate portion is preferably at an included angle $\alpha$, $\beta$ of around 120° to 170° with respect to the respective walls of the first and second portions.

Figure 2:
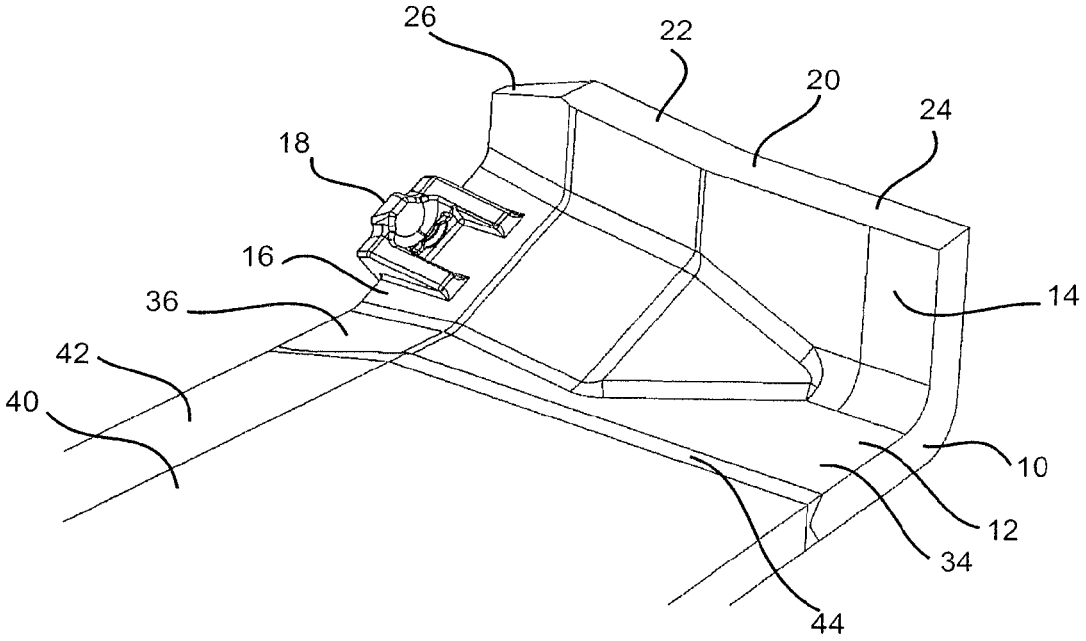
FIG. 2 shows a portion of a bucket of earthmoving equipment, the section having a bucket corner according to an embodiment of the present invention.

FIG. 2 shows the bucket corner 10 welded to a section of bucket floor 40 along a weld line 44. The bucket floor section has a leading tapered front edge or lip 42 corresponding to the edge or lip 36 on the corner.

Figure 3:
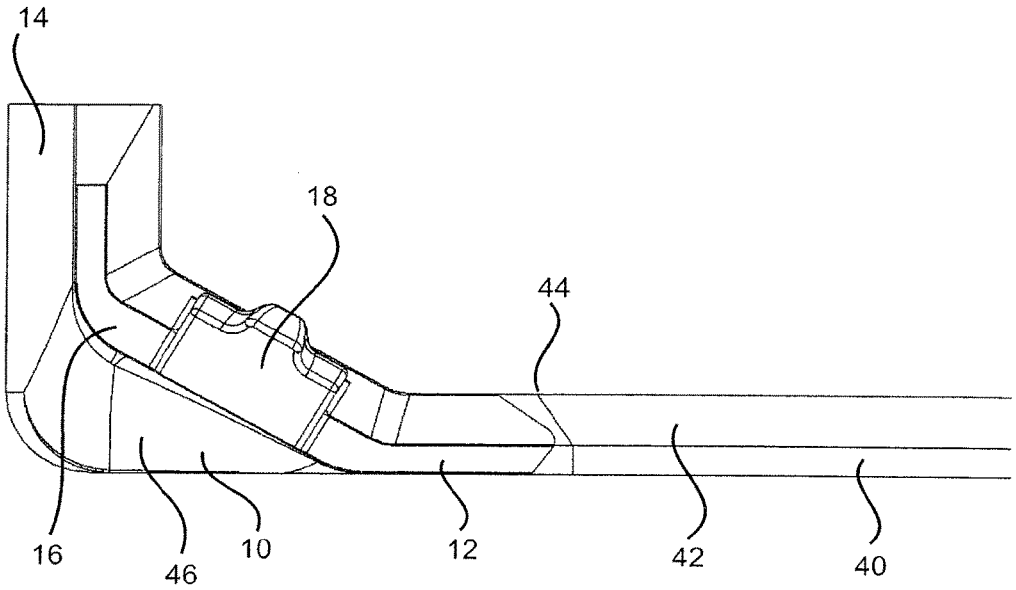
FIG. 3 shows a front view further portion of a bucket of earthmoving equipment, the portion having a bucket corner according to an embodiment of the present invention.

FIG. 3 shows the bucket corner 10 with the wall of the first portion 12 horizontal, the wall of the second portion 14 vertical and the wall of the intermediate portion 16 extending therebetween. The exterior flared section 46 on the underside of the corner can be seen in this front view.

Figure 4:
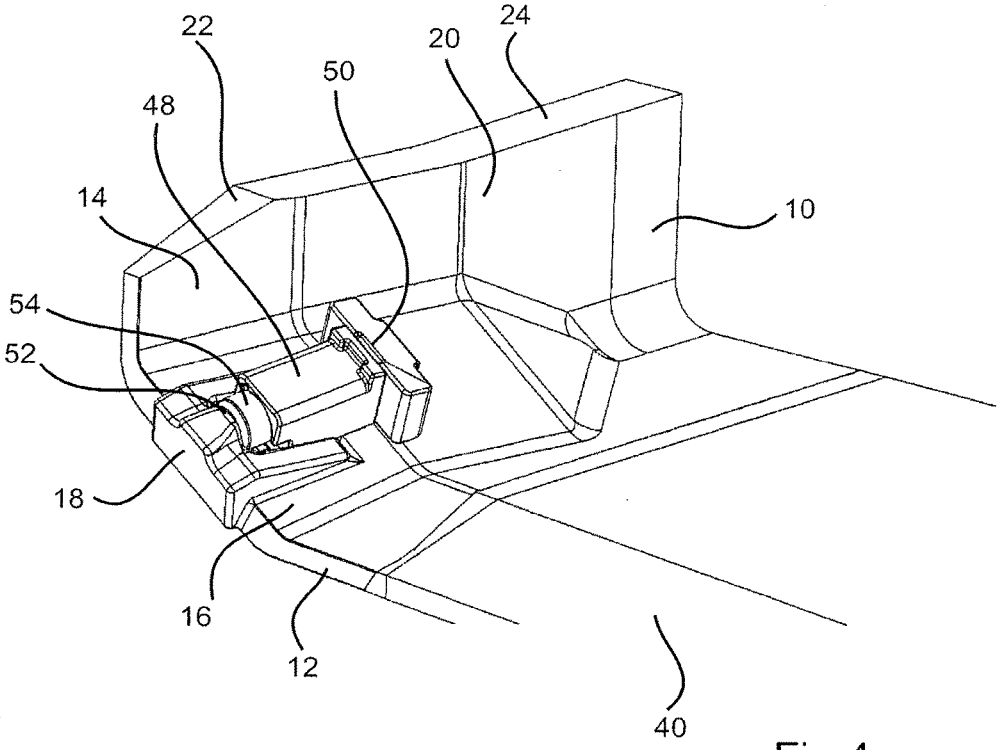
FIG. 4 shows a portion of a bucket of earthmoving equipment, the portion having a bucket corner with a boss, and by way of example, a connection means showing how it would contact the boss, according to an embodiment of the present invention.

FIG. 4 shows the bucket corner with an example of a GET connection means 48 mounted thereon. The connection means includes a spacer 50. This view gives an example of how the piston 54 of the connection means butts up against the contact surface 52 on the boss 18. It will be appreciated that the GET is not shown; however, the connection means would be inserted into the GET to attach the GET to the corner.

Figure 5:
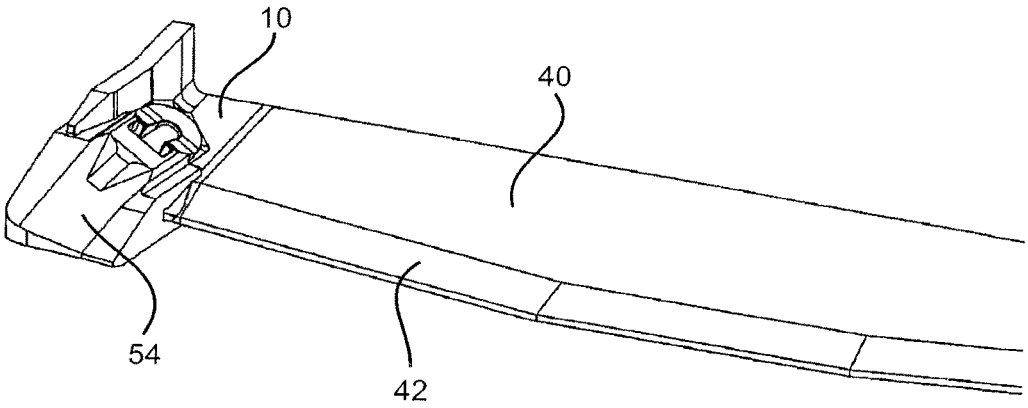
FIGS. 5 and 6 shows a front edge or lip and corner section of a bucket for earthmoving equipment with a GET attached according to an embodiment of the present invention.
Figure 6:
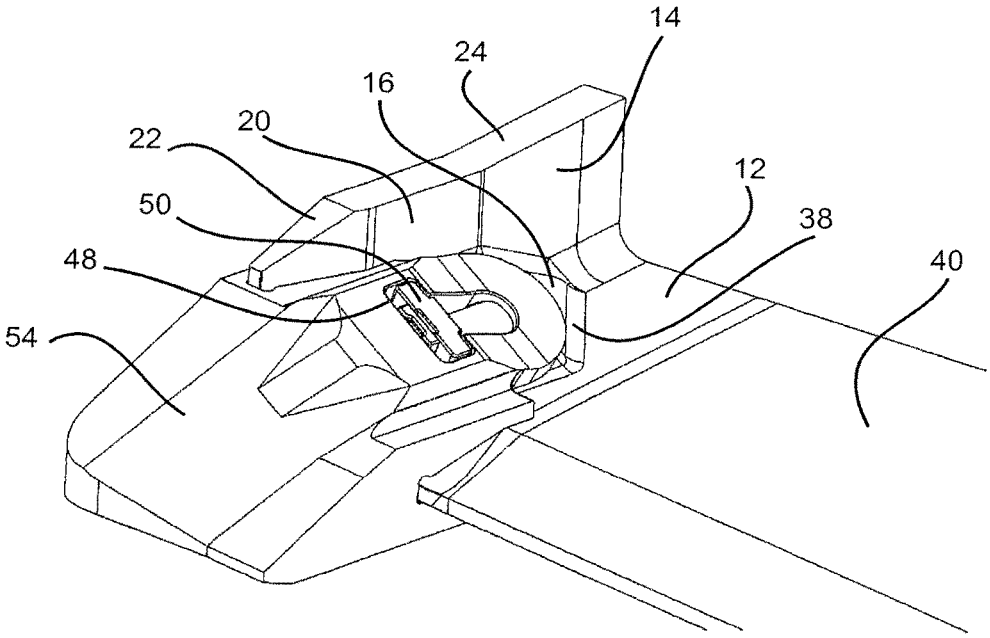

FIG. 5 shows the GET 54 mounted to the bucket corner. FIG. 6 shows the view of FIG. 5 in close up.

Figure 7:
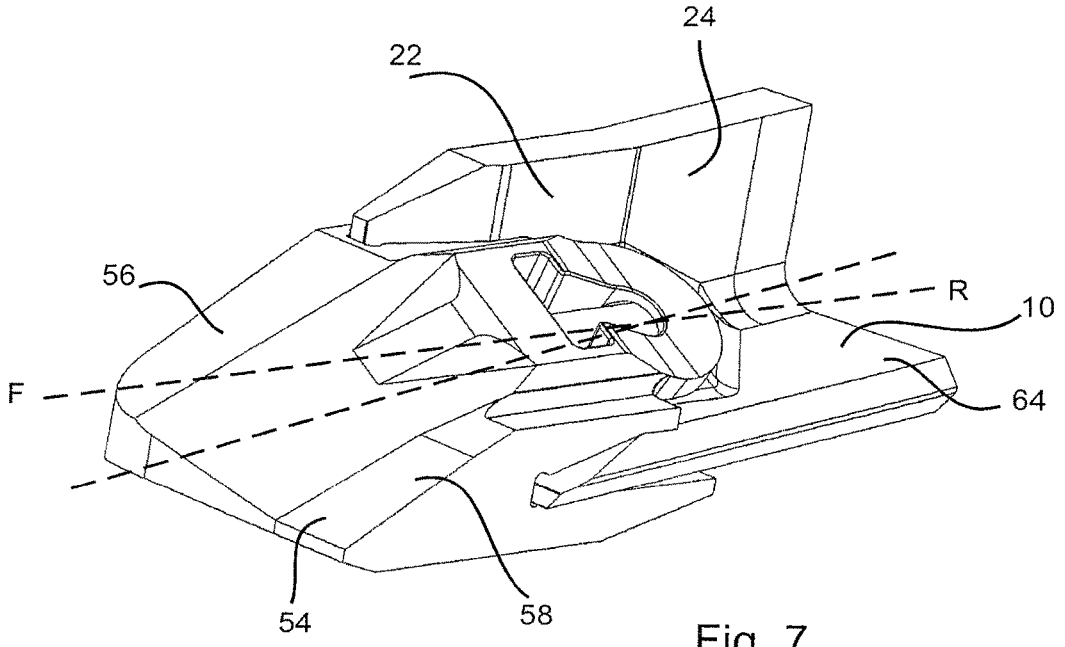
FIG. 7 shows a front perspective of a bucket corner with a corner GET attached, according to an embodiment of the present invention.
Figure 8:
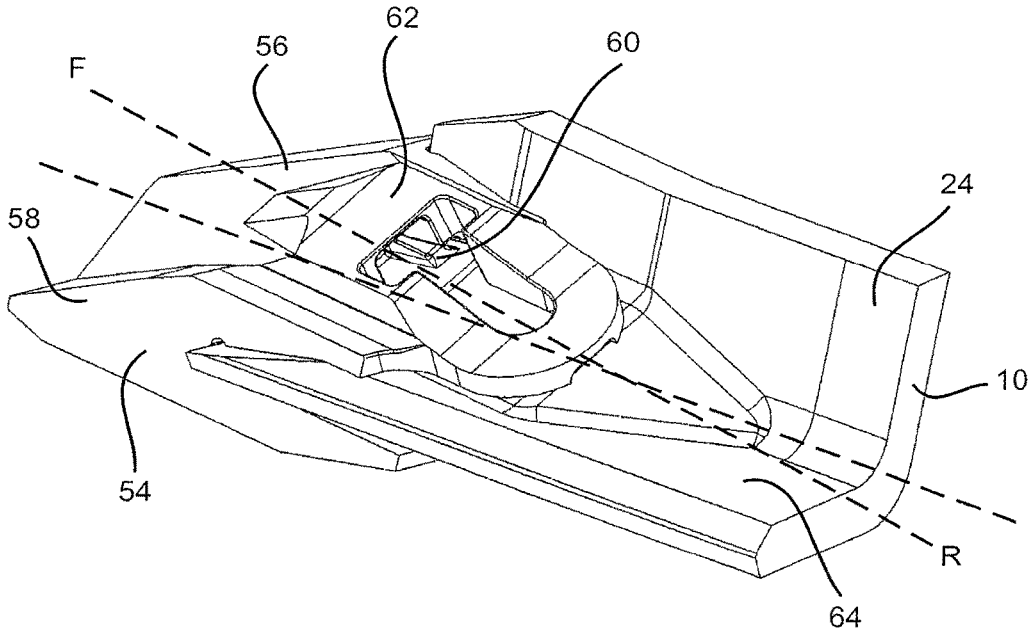
FIG. 8 shows a rear perspective of a bucket corner with a corner GET attached, according to an embodiment of the present invention.

FIGS. 7 and 8 show respective front and rear perspectives of the GET 54 mounted onto the corner 10, though without the connection means in place. The GET 54 has a thickened outside side edge 56 compared to a thinner inner side edge 58. This helps transfer loads and forces through the corner and into the bucket. It will be appreciated the opening 60 into the rear 62 of the GET 54 has an axial alignment F-R to receive the connection means that is angled with respect to the axial line of the corner rear side corner wall portion 24 and rear floor wall portion 64 of the corner. The axial alignment of the opening is angled to correspond to the angle of flaring of the front side wall portion 22 of the corner.

Figure 9:
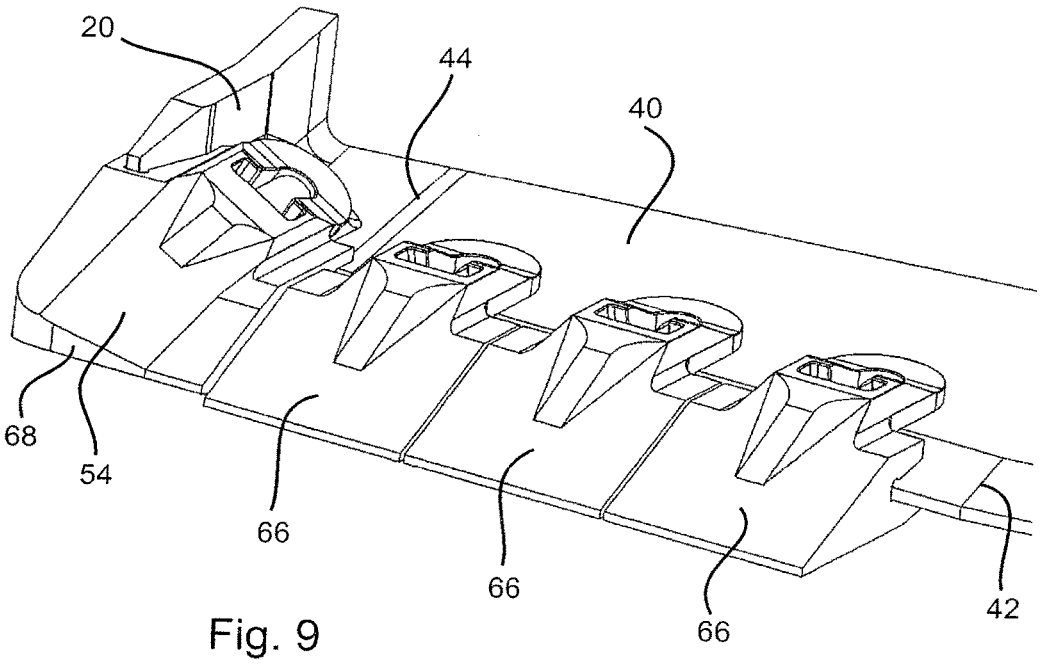
FIG. 9 shows an example of a corner GET and several standard GETs attached to a front edge or lip of a section of a bucket, according to an embodiment of the present invention.

FIG. 9 shows a series of GETs mounted to the front edge or lip of a section of the bucket. Standard GETs 66 are mounted adjacent one another. The corner GET 54 protects the corner 10 of the bucket. The thicker outer edge and thinner inner edge profile of the corner GET of the present invention can be clearly seen in creating the wedge 68 at the front of the GET.

Figure 10:
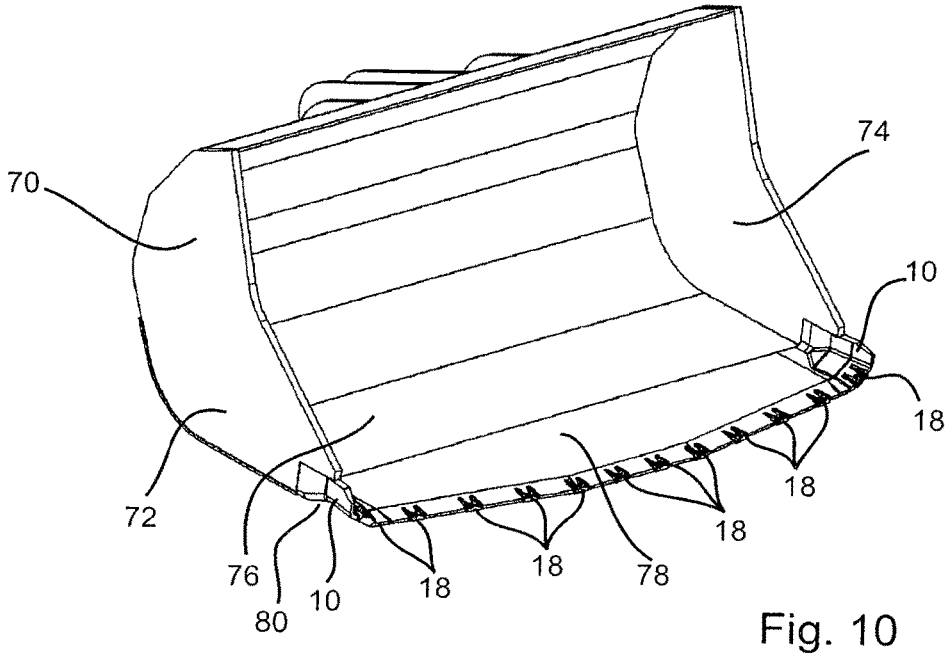
FIG. 10 shows a complete bucket for earthmoving equipment, the bucket including a number of bosses spaced along the front edge or lip thereof and opposed corners according to embodiments of the present invention.

FIG. 10 gives an example of an earthmoving bucket 70 with a number of bosses 18 attached thereto. The bucket corners 10 of the present invention can be seen at either of the lower corners of the bucket. The bucket has two opposed side walls 72, 74 and a bowl 76 that leads to a floor 78 of the bucket. The corners can be seen flaring outwards and having the underside recesses 80 to allow for the thickness of the GET when mounted thereon.

Figure 11:
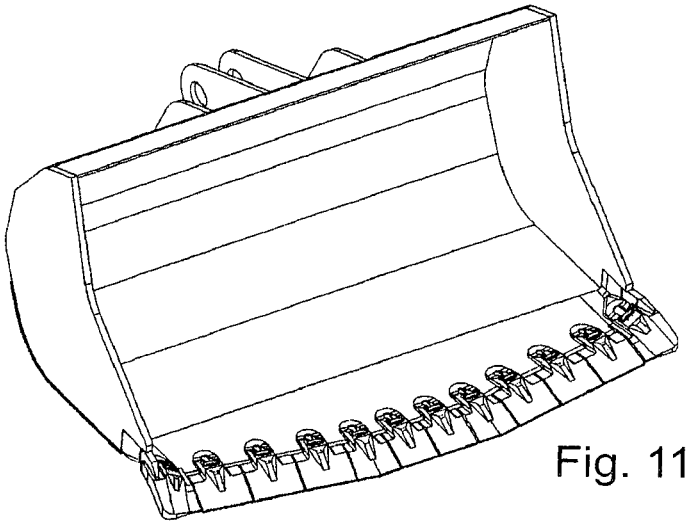
FIGS. 11 and 12 show perspectives of a bucket for earthmoving equipment with corner and standard GETs attached. The bucket includes corners and mounting of GETs according to embodiments of the present invention.
Figure 12:
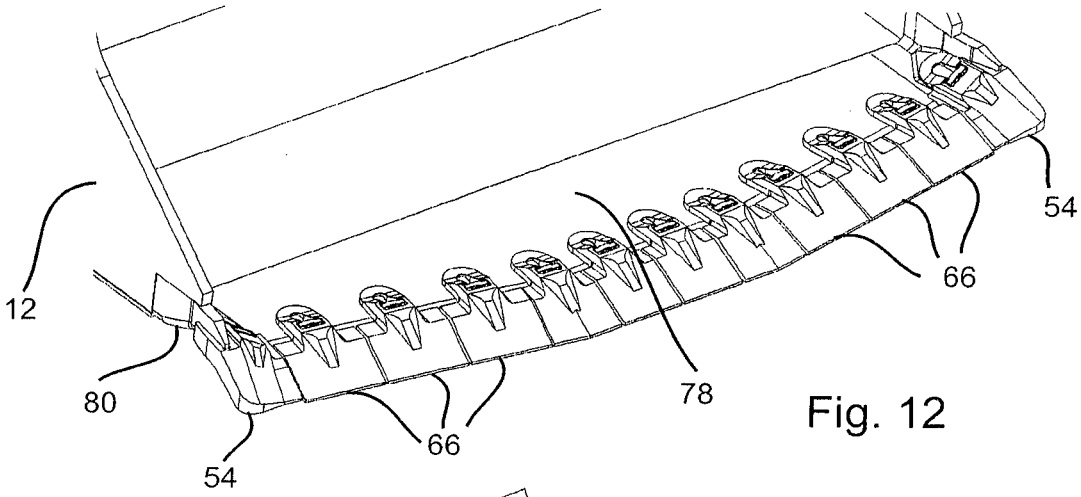

FIG. 11 shows the bucket of FIG. 10 but with corner GETs 54 and standard GETs 66 mounted thereon. One of the corner GETs 54 is shown extending under and around the corner and into the recess 80.

Figure 13:
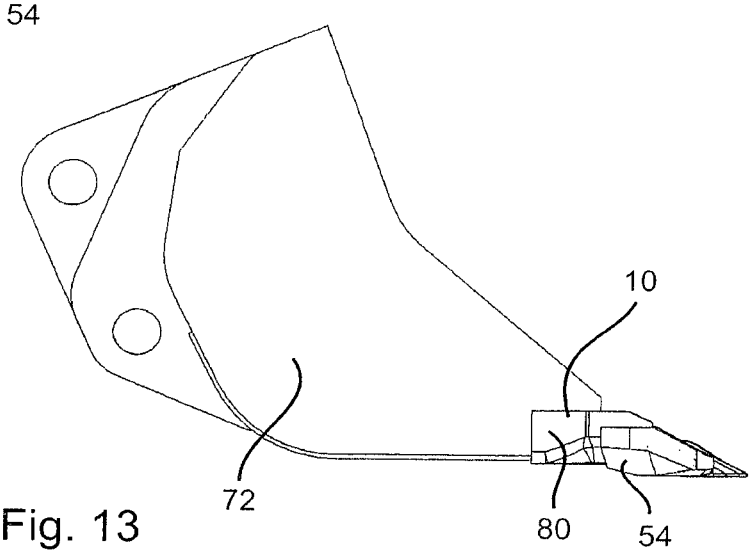
FIG. 13 is a side view of a bucket showing a corner and a GET mounted thereto according to an embodiment of the present invention.

FIG. 13 shows a side view of the corner GET 54 mounted to the corner 10.

Figure 14:
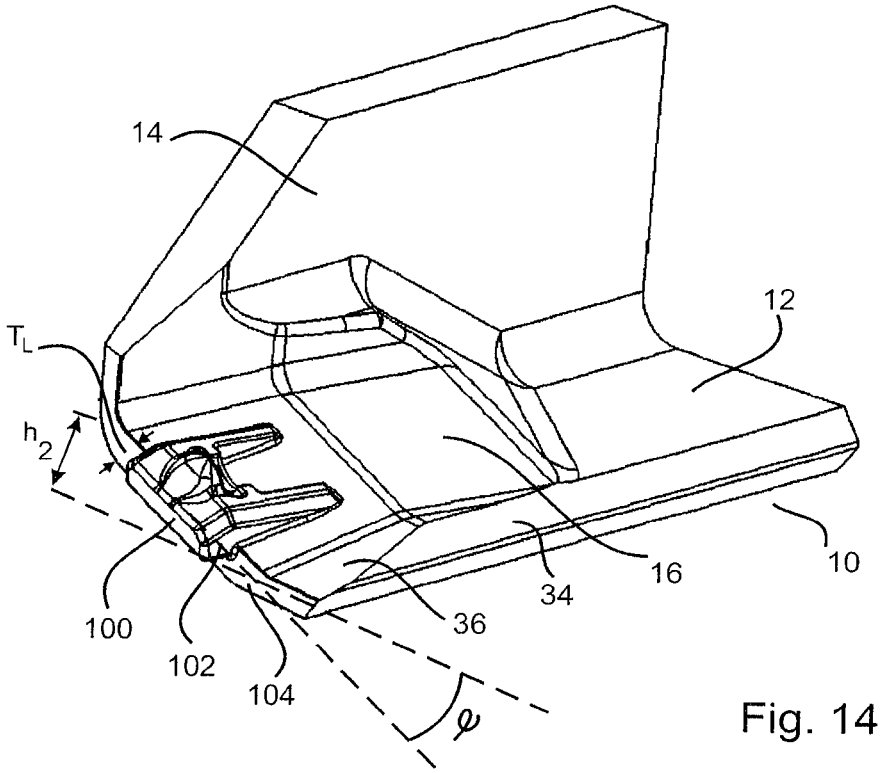
FIGS. 14 to 16 show an alternative embodiment of a bucket corner with a boss according to the present invention.
Figure 15:
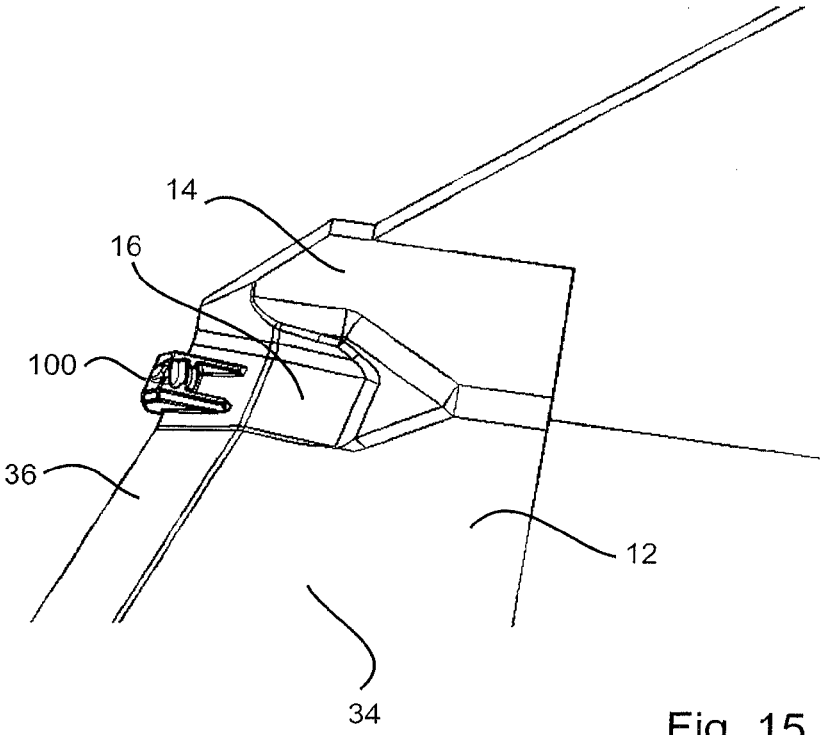

As shown in FIG. 14, the angle $\phi$ is at or approximately 20° compared with the angle $\psi$ at or approximately 30° shown in FIG. 1 with respect to the floor portion 34 of the bucket 10. This 'shallower' angle reduces the height $h_1$ of the corner to height $h_2$. This reduced angle therefore increases the included angle $\beta$ (see FIG. 1) by approximately 10° (e.g. from an included angle $\beta$ of between around 100° to 175° to an included angle of between around 110° to 180°, preferably the included angle is between around 130° and 180°, and more preferably between 130° and 160°. Similarly the included angle $\alpha$ between the plane of the second portion and the plane of the intermediate portion decreases by about 10°.

A lower profile boss 100 is mounted to the front edge of the bucket lip 36. In the embodiment shown, the front portion 102 of the boss 100 extends only partway down the thickness $T_L$ of the lip front edge 104. This provides a corner formed by the underside of the front portion of the boss and the upright exposed front edge of the bucket lip, which gives an improved bearing surface for a stronger mounting of the shroud to the lip.

Figure 16:
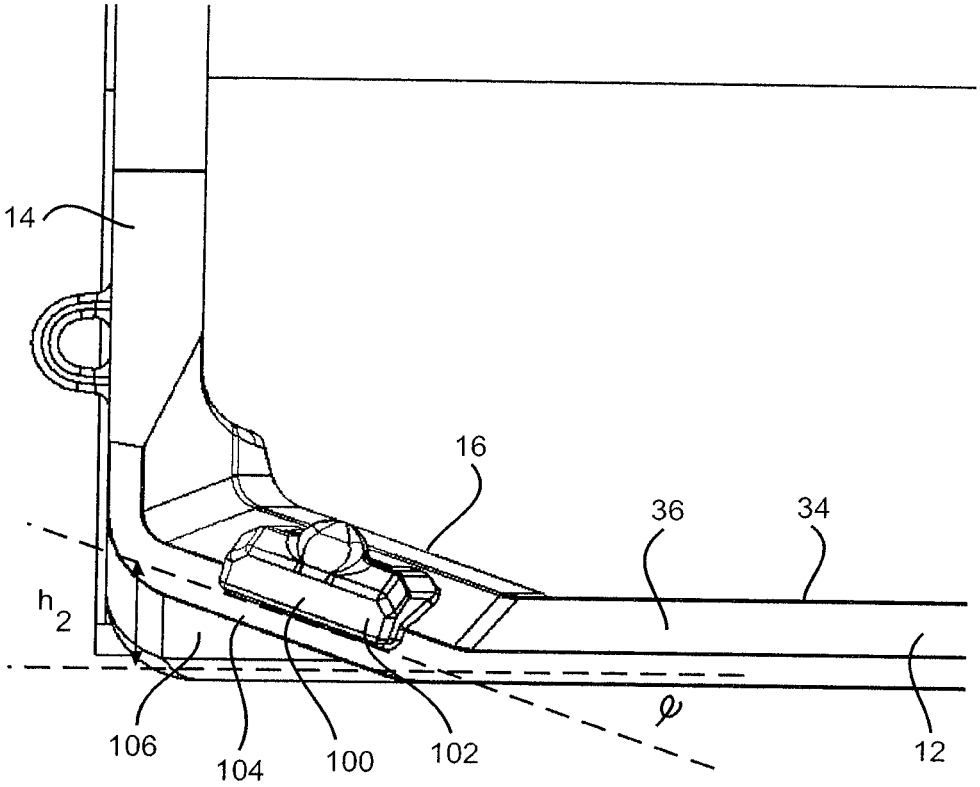

As can be seen in FIG. 16, the reduced angle $\phi$ compared with the embodiment shown in FIG. 1, reduces the height of the corner, and thereby reduces the height of cavity or recess 106 formed external of the corner and behind the boss. This reduces the angle of penetration of the corner GET into material when in use. Also, complexity of the corner is reduced during manufacture because the shallower corner angles reduce the amount of material and steepness of transitional zones to the flat areas on the bucket.

Figure 17:
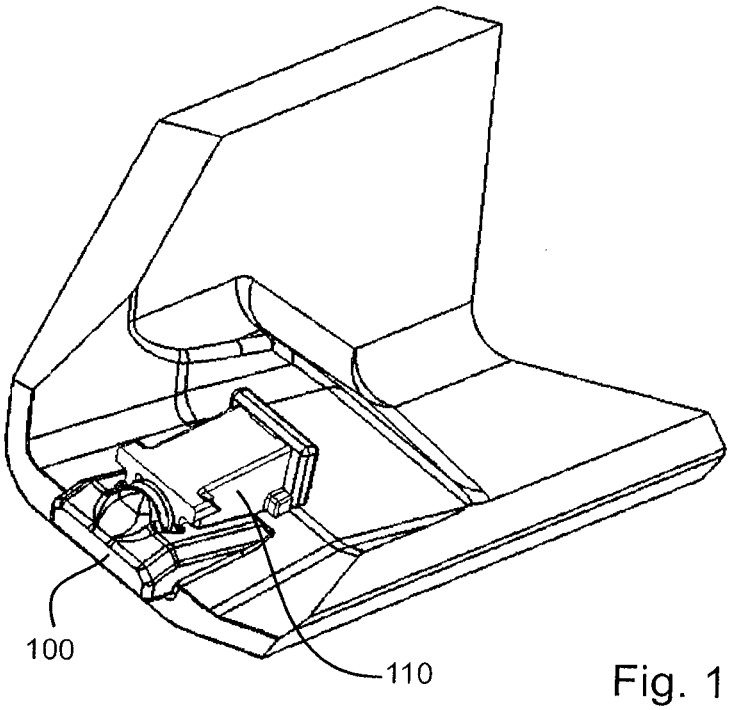
FIG. 17 shows a section of a bucket with a corner and boss according to an embodiment of the present invention, and a representation of a pin block of an attachment system for ground engaging tool positioned on the boss.

The pin block 110 in FIG. 17 is positioned on the boss 100 to show the reduced height of the GET mounting produced by the decreased corner angle and the reduced height boss.

Figure 18:
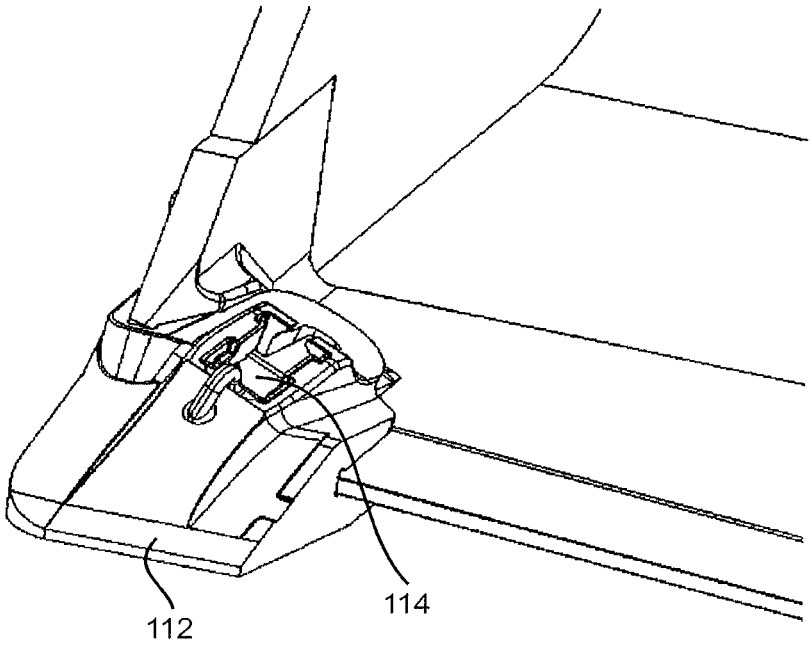
FIG. 18 shows a ground engaging tool mounted to a bucket corner (without pin block in place) according to an embodiment of the present invention.
Figure 19:
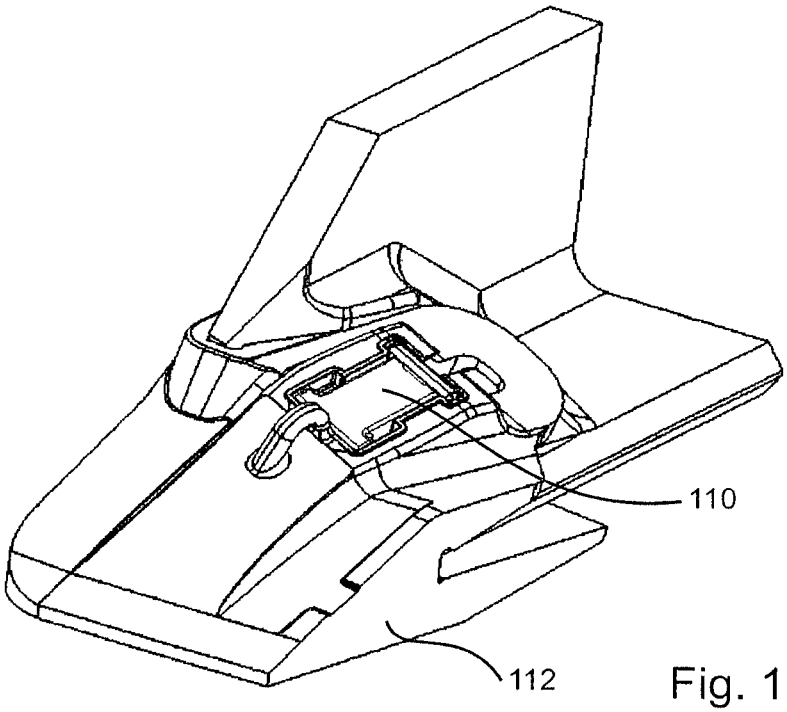
FIG. 19 shows the ground engaging tool shown in FIG. 18 mounted to the bucket corner with pin block in place.

A corner ground engaging tool 112 is shown in FIG. 18 mounted to the aforementioned lower profile corner prior to the pin block 110 being inserted into the opening 114 in the top of the GET to engage against the boss. FIG. 18 shows that pin block in position in the opening and engaged with the boss.

Figure 20:
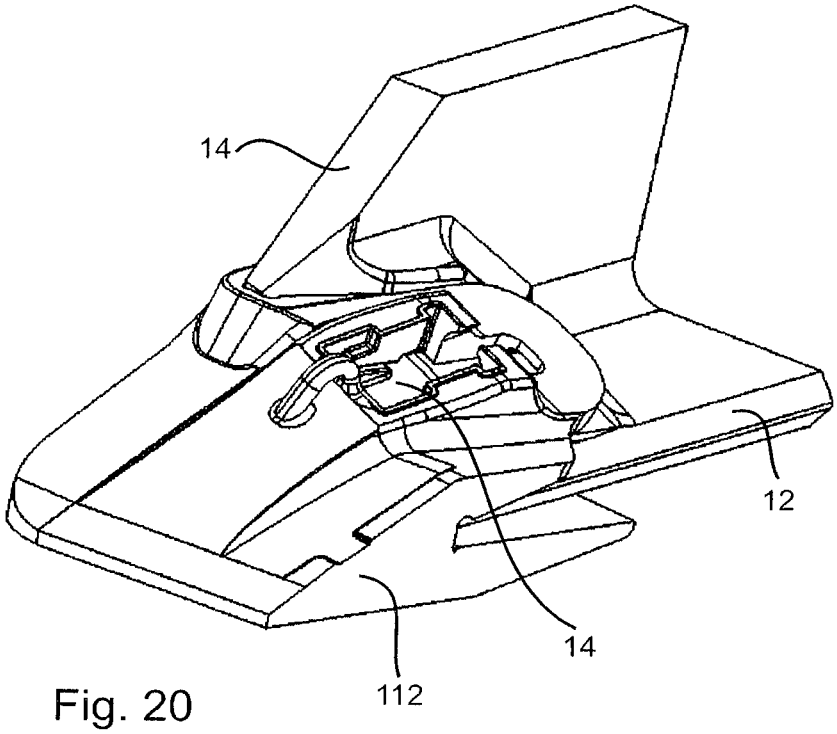
FIGS. 20 and 21 show front and rear perspectives of a ground engaging tool mounted to a bucket corner (portion of bucket shown) according to an embodiment of the present invention.
Figure 21:
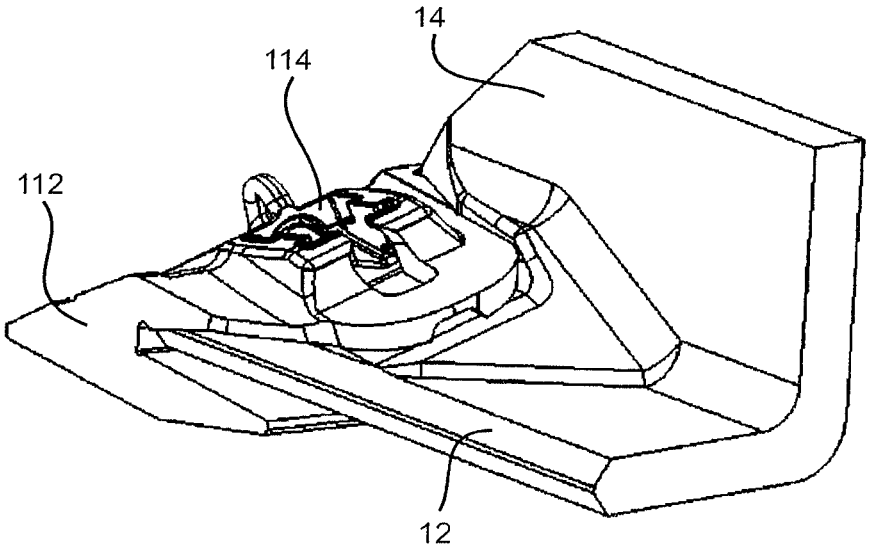

FIGS. 20 and 21 show close up respective front and rear perspectives of the GET 112 mounted to the corner prior to the pin block 110 being inserted into the opening in the GET.

Figure 22:
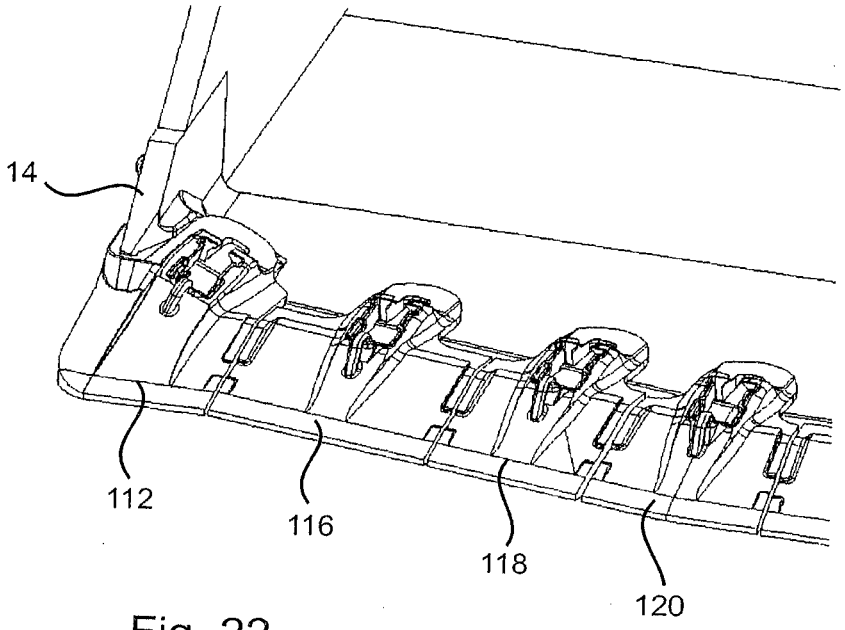
FIGS. 22 to 26 show various views of a ground engaging tool mounted to a bucket corner according to an embodiment of the present invention.

FIG. 22 shows the corner GET 112 and additional GETs 116,118,120 . . . , across the front lip of the bucket, prior to pin blocks being inserted.

Figure 23:
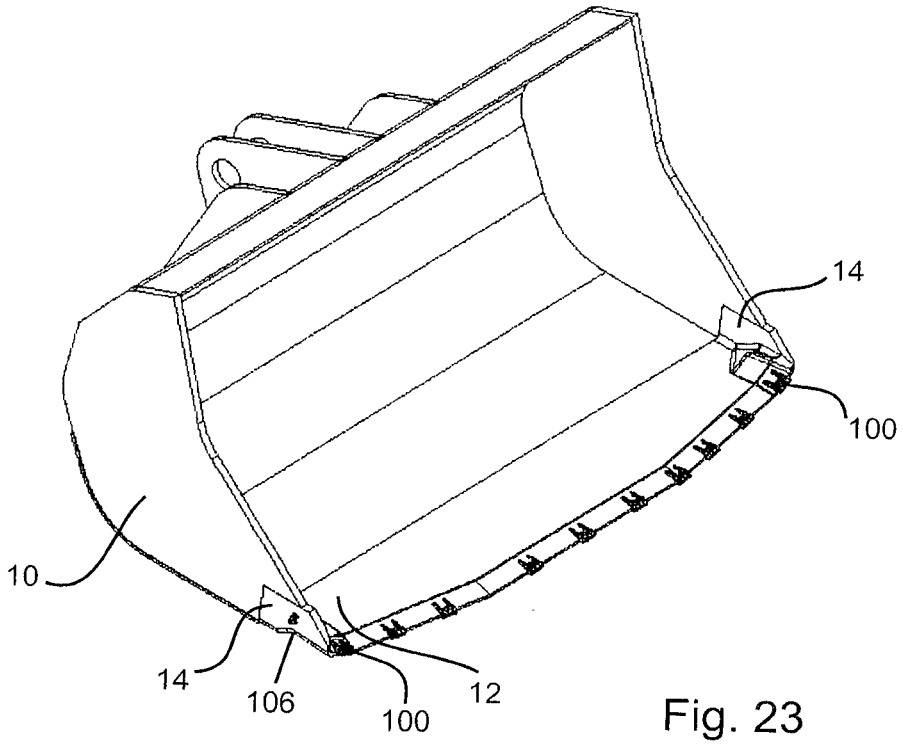

FIG. 23 shows the front lip of the bucket with respective bosses mounted in place and before the GETs are positioned each on their respective boss. The lower profile bucket corner is shown relative to the bulk of the bucket. The lower profile corner reduces the amount of material required to form the bucket corner, and reduces the steepness of transition from the corner to side 14 and bottom 12 planar sections of the bucket.

Figure 24:
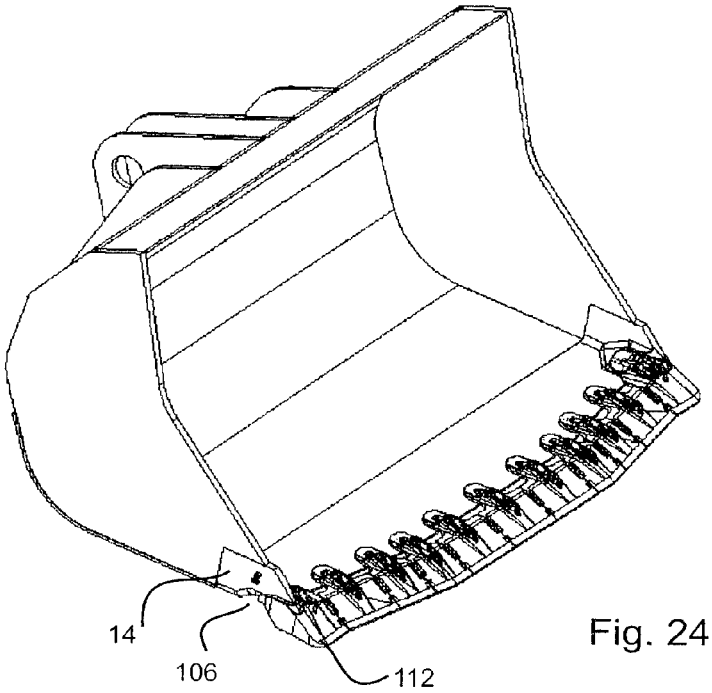
Figure 25:
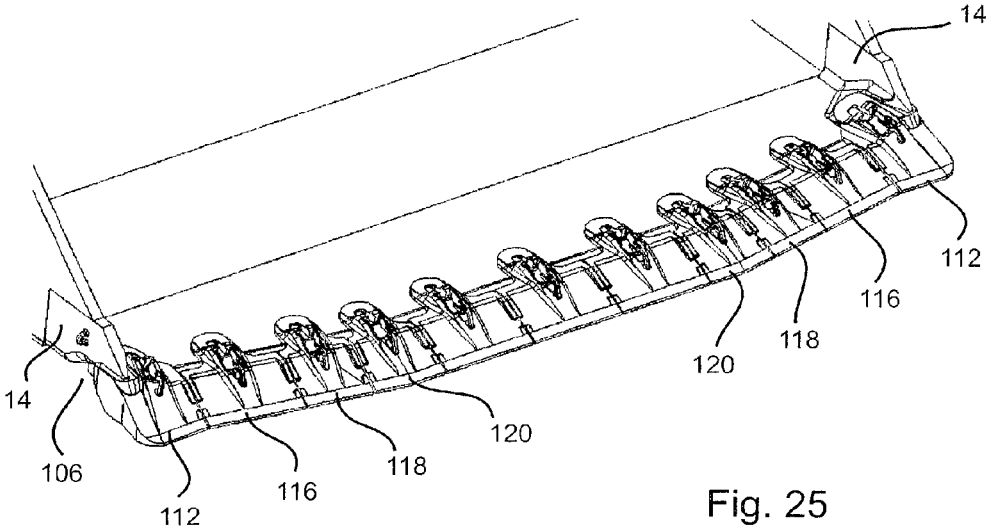
Figure 26:
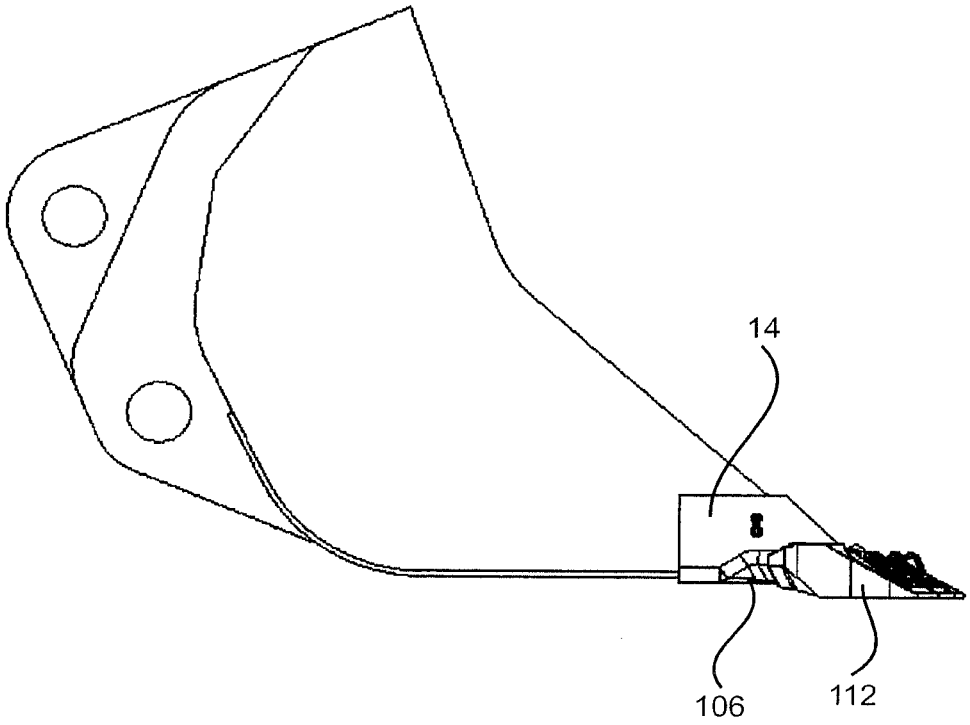

FIGS. 24 to 26 show GETs mounted to the bucket lip, and in particular, indicate the reduced height lower profile of the bucket corner and corner GET.

The claims defining the invention are as follows:

1. An earthmoving equipment bucket corner comprising:

a first portion providing a floor portion for a bucket;

a second portion providing a first wall portion for the bucket; and an intermediate portion extending between the first and second portions, the intermediate portion providing a second wall portion for the bucket, wherein the first, second and intermediate portions are in different planes to one another.

2. The bucket corner of claim 1, wherein the intermediate portion or a plane of the intermediate portion is angled with respect to the first and second portions.

3. The bucket corner of claim 1, wherein the bucket corner is cast as a one piece component.

4. The bucket corner of claim 1, wherein the first and second portions extend beyond a boundary of the intermediate portion and connect together beyond that boundary of the intermediate portion.

5. The bucket corner of claim 1, wherein at least the first and intermediate portions, or at least the second and intermediate portions meet at a radiused continuity of material.

6. The bucket corner of claim 5, wherein a radius of curvature of an internal face of the first and intermediate portions, a radius of curvature of an internal face of the second and the intermediate portions, and a radius of curvature of an internal face of the first and second portions, from one portion to the next are between 5.0 mm and 100.00 mm.

7. The bucket corner of claim 6, wherein the radius of curvature is between 20 mm and 80.00 mm.

8. The bucket corner of claim 1, further comprising a front peripheral region including a boss, lug or adapter thereon for mounting a ground engaging tool or wear plate to the corner.

9. The bucket corner of claim 1, the intermediate portion or the plane of the intermediate portion is angled at 120° to 170° with respect to at least one of the first and second portions.

10. The bucket corner of claim 1, wherein the intermediate portion blends into at least one of the first portion and the second portion by a respective continuous curve of material.

11. The bucket corner of claim 1, wherein the bucket corner widens between a front region and a rear region thereof.

12. The bucket corner of claim 1, further comprising a first exterior surface that forms part of an interior bowl of the bucket for receiving material into the bucket, and a second exterior surface that forms part of an exterior surface of the bucket for contact with material exterior to the bucket.

13. The bucket corner according to claim 12, wherein the second exterior surface of the corner includes a recessed region arranged to receive part of a ground engaging tool when mounted to the corner.

14. The bucket corner of claim 13, wherein a rear exterior region of the bucket corner beyond the recessed region widens out the bucket corner so that a greater amount of material is included in the corner.

15. The bucket corner of claim 1, wherein at least one of a plane of the first portion and a plane of the second portion meets a plane of the intermediate portion at a respective included angle of between around 100° and 175°.

16. The bucket corner of claim 15, wherein the included angle is between around 120° and 170°.

17. The bucket corner of claim 16, wherein the included angle is between 120° and 150°.

18. A ground engaging tool including a wear part for engagement with material when in use and a mounting portion to mount the ground engaging tool to earthmoving equipment, the mounting portion including an internal opening into the ground engaging tool, the opening having a first portion providing a floor portion for a bucket, a second portion providing a first wall portion for the bucket and an intermediate portion between the first and second portions, the intermediate portion providing a second wall portion for the bucket, wherein the first, second and intermediate portions are in different planes to one another.

19. The ground engaging tool of claim 18, wherein the first, second and intermediate portions are arranged such that the opening into the ground engaging tool receives respectively a first bucket corner portion, a second bucket corner portion and an intermediate bucket corner portion of a bucket corner, the first, second and intermediate bucket corner portions also being in different planes to one another.

20. The ground engaging tool of claim 18, wherein the wear part is arranged to protect the corner of the bucket.

21. A ground engaging tool system, including a ground engaging tool, a bucket corner and a connection means, the ground engaging tool including a wear part for engagement with material when in use and a mounting portion to mount the ground engaging tool to earthmoving equipment, the mounting portion including an internal opening into the ground engaging tool, the opening having a first portion providing a floor portion for a bucket, a second portion providing a first wall portion for the bucket and an intermediate portion between the first and second portions, the intermediate portion providing a second wall portion for the bucket, wherein the first, second and intermediate portions are in different planes to one another, the first, second and intermediate portions being arranged such that the opening into the ground engaging tool receives respectively a first bucket corner portion, a second bucket corner portion and an intermediate bucket corner portion of a bucket corner, the first, second and intermediate bucket corner portions are also in different planes to one another, and the connection means arranged to connect the ground engaging tool to the bucket corner.

* * * * *